United States Patent [19]

Lee et al.

[11] 4,384,758

[45] May 24, 1983

[54] ELECTRICAL CONNECTOR

[75] Inventors: Noel Lee, Daly City; Andrew L. Choy, San Francisco, both of Calif.

[73] Assignee: Monster Cable Products, Inc., San Francisco, Calif.

[21] Appl. No.: 331,764

[22] Filed: Dec. 17, 1981

[51] Int. Cl.[3] ..... H01R 11/10

[52] U.S. Cl. ..... 339/267; 339/75 R

[58] Field of Search ..... 339/75 R, 75 A, 75 P, 339/252 R, 252 P, 267

[56] References Cited

U.S. PATENT DOCUMENTS 2,593,981 4/1952 Capita .

2,851,669 9/1958 Koch ..... 339/75 R

FOREIGN PATENT DOCUMENTS 258622 2/1927 Fed. Rep. of Germany ..... 339/267

*Primary Examiner*—Joseph H. McGlynn

[57] ABSTRACT

An electrical connector for effecting connection between a wire and a 'banana' type socket includes an axially extending male pin divided by a slot(s) into radially expansible contact arm quadrants. A terminal fastener is mounted in threaded engagement on the pin for securing an electrical terminal between the terminal fastener and an annular portion of the pin. An expander element is also mounted in threaded engagement on the pin and includes an expander rod having a frusto conical tip portion that enters and engages a tapered internal bore of the pin to permit the contact arm quadrants to be forced outward to grip the smooth internal bore of the 'banana' type socket.

24 Claims, 6 Drawing Figures

ELECTRICAL CONNECTOR

CROSS REFERENCE TO RELATED APPLICATIONS

The subject matter of the present application is related to that disclosed in pending U.S. patent application Ser. No. (A-15,011) filed June 18, 1981 by Noel Lee and Andrew L. Choy and entitled "Electrical Connector."

BACKGROUND OF THE INVENTION

The present invention relates to electrical connectors and, more particularly, to electrical connectors for improving the connection between a current carrying wire and a 'banana' type connector and especially between large-sized wire cables used in high power audio systems and the 'banana' type sockets found on many loudspeakers, amplifiers, and related equipment used in audio systems.

In entertainment-type audio systems, including systems used in the home and in commerical environments, the loudspeakers have traditionally been connected to the audio amplifier through loudspeaker wires with the actual connection between the end of the wires and the loudspeaker and the amplifier effected through various types of electrical connecting devices. Historically, these connecting devices have included a 'banana' type jack and socket arrangement in which the socket includes a smooth internal bore that receives the male connecting pin of the cooperating jack. The pin is usually designed to resiliently expand in the radial direction to resiliently engage the interior bore of the threaded sleeve. In this type of expanded pin design, the quality of the resulting electrical connection is a function, in part, of the outward resilience of the pin. One problem that is associated with this type of design is the loss of resilience of the pin due to mechanical fatigue and heating caused by high current loads, which results in a lower quality interconnection between the pin and the socket. In extreme cases, the inter-engagement between the male pin and its socket can be so poor that the electrical connection becomes intermittent. In spite of these drawbacks, 'banana' type sockets have generally been satisfactory for their intended purpose since their plug-in design makes them convenient to use.

In recent years, there has been a tendency in home and commercial audio entertainment systems to vastly increase the power level delivered to the loudspeakers. These higher power systems have included amplifiers adapted to provide several hundred watts of power to loudspeakers capable of handling those power levels. It has been recognized in these powerful systems that losses can be encountered in the traditionally used loudspeaker wire. In response to this realization, these higher power systems have used larger capacity wire cables to deliver the audio energy from the amplifiers to the loudspeakers. However, since the traditional interconnection between the larger capacity speaker wire and the loudspeaker and/or amplifiers is still generally limited to the traditional 'banana' type plug and jack arrangement, in these relatively high power systems it can be appreciated that the above problems associated with these arrangements are severely compounded. Accordingly, there is a need for a more reliable and audio-power efficient interconnection between high capacity speaker wires used in high power audio systems and the 'banana' type sockets traditionally used on the vast majority of existing loudspeakers and audio amplifiers.

SUMMARY OF THE INVENTION

Accordingly, it is an object of the present invention, among others, to provide an electrical connector that efficiently effects connection between traditional 'banana' type sockets and an audio power cable in which losses attributable to the design of the 'banana' type pin/socket arrangement are minimized.

It is also another object of the present invention to provide a connector for efficiently connecting a loudspeaker wire to a traditional 'banana' type socket in which the possibility of an intermittent connection attributable to the design of the 'banana' type and socket arrangement is minimized and in which the connect-/disconnect convenience of the 'banana' type socket is largely retained.

In accordance with these objects, and others, the present invention provides an electrical connector for effecting the mechanical and electrical connection between the current carrying wire and a traditional 'banana' type socket. The connector includes an axially extending pin having at least one radially expansible conductor element. The pin has an internal bore and both internal and external threads at one end thereof. An internally threaded terminal fastener is threadedly engaged with the external threads at the one end of the male pin for securing a terminal between the fastener and a terminal receiving portion of the male pin. An expander element, including an axially extending shaft portion, is inserted within the internal bore of the male pin and a threaded portion thereof engages the internal threads of the male pin. In response to selected adjustment of the expander element, the shaft portion engages the internal surface of the male pin portion to cause the expansible conductor portion to expand radially outward and forcibly grip the interior of the socket to provide both a mechanical and electrical connection.

The terminal fastener includes at least one flat side surface for engaging the bent ends of a bifurcated terminal lug as an aid in preventing unintentional loosening of the terminal and as an aid in connecting the terminal to the connector without tools.

The disclosed connector facilitates effective electrical connection between loudspeakers, amplifiers and similar apparatus having 'banana' type sockets and electrical cables designed to carry high power levels without compromising the convenient connect/disconnect feature of the traditional 'banana' type plug.

BRIEF DESCRIPTION OF THE DRAWINGS

The above description, as well as further objects, features, and advantages of the present invention will be more fully understood by reference to the following description of a presently preferred but nonetheless illustrative embodiment in accordance with the present invention, when taken in connection with the accompanying drawings wherein.

DESCRIPTION OF THE PREFERRED EMBODIMENT

Figure 1:
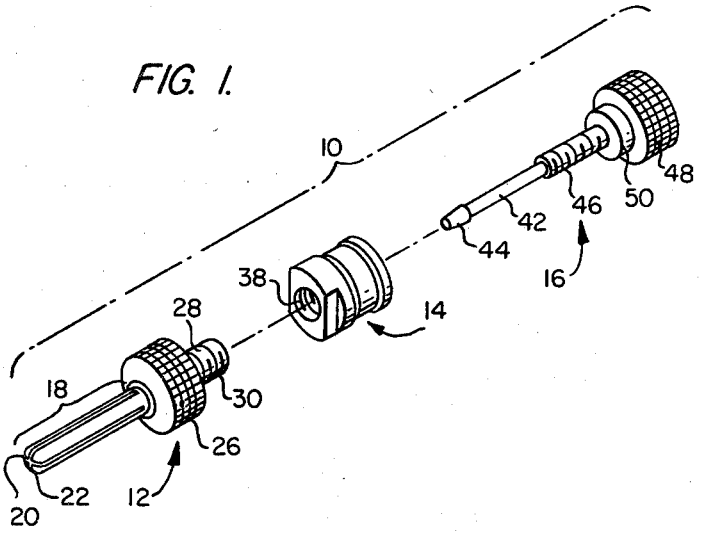
FIG. 1 is an exploded perspective view of an exemplary electrical connector in accordance with the present invention.

A preferred embodiment of an electrical connector in accordance with the present invention is shown in exploded perspective in FIG. 1 and is generally designated therein by the reference character 10. The connector 10 includes an axially extending male pin 12, a terminal securing nut or fastener 14, and an expander element 16.

Figure 1A:
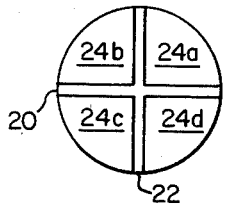
FIG. 1A is an enlarged end view of a pin portion of the connector shown in FIG. 1.

The pin 12 includes a contact portion 18 that has two mutually perpendicular, diametrically aligned slots 20 and 22 formed therein that divide the contact portion 18 into contact arm quadrants (FIG. 1A) 24A, 24B, 24C, and 24D. The slots 20 and 22 and the resulting contact arm quadrants 24A . . . D provide the contact portion 18 of the pin 12 with a measure of radially outward resilience as is known in the art. An annular flange 26 is located at the base of the contact portion 18, and a reduced diameter mounting stud 28 having external threads 30 extends axially rearward of the flange 26. If desired, the peripheral surface of the flange 26 can be striated or knurled to provide a gripping-enhanced surface.

Figure 2:
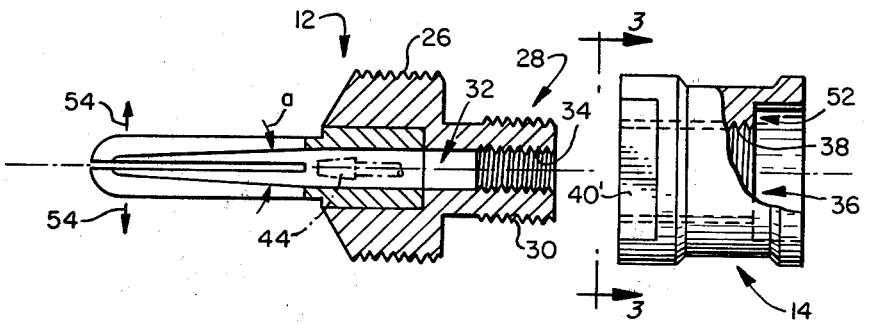
FIG. 2 is an exploded side view, in partial cross section, of the male pin and terminal fastener portion of the connector shown in FIG. 1.

As shown in FIG. 2, the pin 12 includes an axially aligned bore 32 that is adapted to receive the expander element 16 as described more fully below. The bore 32 is tapered in the direction of the tip or end of the contact portion 18 at a selected taper angle "a" and includes internal threads 34 at the stud end of the pin 12 for engaging the expander element 16. For example, the taper angle "a" can be in the range of 10°–25°.

Figure 3:
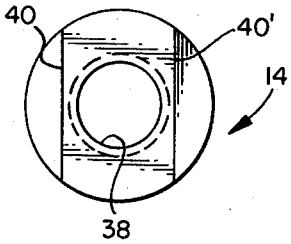
FIG. 3 is an end view of the terminal fastener portion of the electrical connector taken along line 3—3 of FIG. 2.
Figure 5:
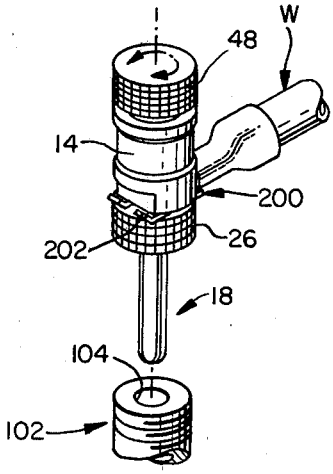
FIG. 5 is a partial perspective view of the electrical connector of FIG. 1 having an exemplary bifurcated wire terminal connected thereto.

The terminal fastener 14 is formed as a generally cylindrical body of revolution having an internal bore 36 provided with threads 38 for engaging the external threads 30 of the stud 28. As shown in FIGS. 1, 2, and 3, the terminal fastener 14 includes two parallel chordal flats, 40 and 40', that assist in securing a bifurcated wire lug 200 between the flange 26 and the terminal fastener 14 as shown in FIG. 5 and as described more fully below.

The expander pin 16 includes an elongated shaft portion 42 having a frusto conical tip portion 44 at one end that is formed at a cone angle that is substantially identical to that of the taper angle "a" of the bore 32 of the pin 12. The end of the shaft 42 opposite the tip 44 includes external threads 46 that are adapted to engage the internal threads 34 of the stud 28. An adjusting knob 48 is provided at the end of the shaft 42 opposite the tip 44. As in the case of the flange 26, the peripheral surface of the adjusting knob 48 may be striated or otherwise knurled to provide a gripping-enhanced surface. If desired, the expander element 16 may by provided with a cylindrical shoulder formation 50 adjacent the adjusting knob 48 that cooperates with a complementary counterbore 52 formed in the terminal fastener 14.

In assembled form, the terminal fastener 14 is mounted upon the stud 28 with the chordial flats 40 and 40' facing the flange 26 to define opposing terminal seating surfaces. The expander element 16 is inserted through the so-assembled pin 12 and terminal fastener 14 with the tip 44 positioned in the tapered portion of the bore 32 of the tip 12 as shown in broken line illustration in FIG. 2. As the adjusting knob 48 is rotated, the tip portion 44 of the expander element 16 can be advanced into the tapered portion of the bore 32 to cause the tip 44 to contact the interior surfaces of the contact arm quadrants 24A . . . D to force the contact arm quadrants radially outward as indicated by the arrows 54 in FIG. 2.

The electrical connector 10 shown in FIGS. 1–3 is adapted to connect a current carrying conductor, especially a large diameter speaker wire W (FIG. 5) typically used in high power audio entertainment systems, to a loudspeaker of the type having conventional 'banana' type sockets 100 (FIG. 4) that typically include a hollow tubular post 102 having a smooth internal bore 104 and external threads 106 and a binding nut 108 that threadedly engages the external threads 106 on the tubular member 102.

Figure 4:
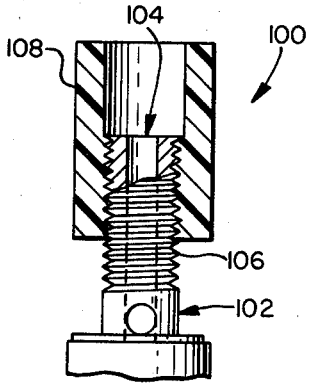
FIG. 4 is a side view, in cross section of a conventional 'banana' type socket suitable for use with the electrical connector shown in FIG. 1.

The electrical connector 10 may be used to effect the electrical interconnection between a current carrying wire and the standard 'banana' type socket 100 shown in FIG. 4 in at least two different ways. For example, the contact portion of the pin 12 can be inserted into the bore 104 of the socket 100 and the adjusting knob 48 rotated to advance the tip 44 into the tapered bore 32 of the pin 12. As the tip 44 advances into the tapered bore 32, the tip 44 contacts the internal surfaces of the contact arm quadrants 24A . . . D and causes the contact arm quadrants to expand radially outward to forcibly grip the internal bore 104 of the socket 100 to thereby effectively lock the contact portion of the pin 12 to the socket 100. Thereafter, the terminal fastener 14 is rotated to provide a space for the insertion of a bifurcated terminal lug 200 (FIG. 5) between the opposing faces of the annular flange 26 and the terminal fastener 14. After the terminal lug 200 is inserted into the space between the terminal fastener 14 and the annular flange 26, the terminal fastener 14 is rotated to effectively clamp the bifurcated terminal 200 between the terminal fastener 14 and the annular flange 26. The chordal flats 40 and 40' provided on the terminal fastener 14 are designed to assist in effecting connection to bifurcated terminal fasteners 200 having upturned ends 202 (FIG. 5). More particularly, the chordal flats 40 and 40' engage the upturned ends 202 of the bifurcated terminal 200 to permit the terminal to be rotated in a crank-like fashion to effect tightening. In the alternative, a terminal 200 may first be secured to the connector 10 between the terminal fastener 14 and the annular flange 26 and thereafter the contact portion 18 of the pin 12 inserted into the smooth internal bore 104 of the socket 100 and the adjusting knob 48 rotated to effect the aforedescribed locking.

Once the electrical connector 10 is secured in place within the socket 100, it can not be removed unless the adjusting knob 48 is counter rotated to retract the tip 44 from the tapered portion of the internal bore 32 and permit the contact arm quadrants 24A . . . D to relax and the pin 12 to be removed from the socket 100.

The frusto conical tip 44 and the complementary tapered portion of the bore 32 are merely exemplary of various designs suitable for adjustibly causing the male pin 12 to expand to effect the desired gripping action.

As can be appreciated by those skilled in the art, various changes and modifications may be made to the disclosed embodiment of the electrical connector without departing from the spirit and scope of the invention as recited in the appended claims and their legal equivalent.

What is claimed is:

1. An electrical connector for connection to a connector of the type having a pin-receiving bore, said electrical connector comprising:

an elongated male pin member for insertion into the pin-receiving bore of a post-type connector, said pin member having a flat surface portion, at least one expansible conductor portion and a tapered internal bore;

a terminal fastener member for securing an electrical terminal between said terminal fastener and said flat surface portion of said pin member;

an adjustable expander member having an elongated expander rod extending through said fastener member, and having a tapered portion positioned within said tapered internal bore of said pin member for expanding at least one conductor portion; and means connecting said members in a manner to permit relative movement between said expander member and said pin member to effect said expanding and to permit relative movement between said fastener member and said pin member to effect said securing.

2. The electrical connector claimed in claim 1 wherein said expander rod extends through a bore formed in said terminal fastener member.

3. The electrical connector claimed in claim 1 wherein said pin member has a outwardly extending flange on which said flat surface portion is formed.

4. The electrical connector claimed in claim 1 wherein said connecting means comprises threads disposed on each of said member to establish a threaded engagement between said members.

5. The electrical connector claimed in claim 4 wherein said fastener member and said expandable member are each in threaded engagement with said pin member.

6. The electrical connector claimed in claim 5 wherein said pin member has an externally and internally threaded stud for threaded engagement by said fastener member and said expander member, respectively.

7. The electrical connector claimed in claim 1 wherein said fastener member includes at least one flat surface formed along a chord line thereof.

8. The electrical connector claimed in claim 7 wherein said fastener member includes at least two flat surfaces formed along parallel chordal lines thereof.

9. An electrical connector for connection to a connector of the type having a pin-receiving bore, said electrical connector comprising;

an elongated male pin for insertion into the pin-receiving bore of a post-type connector, said pin having at least one expansible conductor portion, a tapered internal bore and an outwardly extending flange;

a terminal fastener in threaded engagement with said pin for securing an electrical terminal between said terminal fastener and said flange; and an adjustable expander having an elongated expander rod in threaded engagement with said pin, said expander rod having a tapered portion positioned within said tapered internal bore of said pin and adjustable to cause said at least one expansible conductor portion to expand outwardly.

10. An electrical connector claimed in claim 9 wherein said expander rod extends through a bore formed in said terminal fastener.

11. The electrical connector claimed in claim 9 wherein said pin has an externally and internally threaded stud for engagement by said fastener and said expander, respectively.

12. The electrical connector claimed in claim 9 wherein said fastener includes at least one flat surface formed along a chord line thereof.

13. The electrical connector claimed in claim 12 wherein said fastener includes at least two flat surfaces formed along parallel chordal lines thereof.

14. An electrical connector for connection to a connector of the type having a pin-receiving bore, said electrical connector comprising:

an elongated male pin for insertion into the pin-receiving bore of a post-type connector, said pin having at least one expansible conductor portion, a tapered internal bore and an internally and externally threaded stud;

a terminal fastener in threaded engagement with said stud for securing an electrical terminal between said terminal fastener and a surface portion of said pin; and an adjustable expander having an elongated expander rod in threaded engagement with said stud, said expander rod having a tapered portion positioned within said tapered internal bore of said pin and adjustable to cause said at least one expansible conductor portion to expand outwardly.

15. The electrical connector claimed in claim 14 wherein said expander rod extends through a bore formed in said terminal fastener.

16. The electrical connector claimed in claim 14 wherein said fastener is in engagement with the external threads of said stud and wherein said expander is in engagement with the internal threads of said stud.

17. The electrical connector claimed in claim 14 wherein said pin has a outwardly extending flange on which said surface portion is formed.

18. The electrical connector claimed in claim 14 wherein said fastener includes at least one flat surface formed along a chord line thereof.

19. The electrical connector claimed in claim 18 wherein said fastener includes at least two flat surfaces formed along parallel chordal lines thereof.

20. An electrical connector for connection to a connector of the type having a pin-receiving bore, said electrical connector comprising:

an elongated male pin for insertion into the pin-receiving bore of a post-type connector, said pin having at least one expansible conductor portion and a tapered internal bore;

a terminal fastener in threaded engagement with said pin for securing an electrical terminal between said terminal fastener and a surface portion of said pin; and an adjustable expander element having an elongated expander rod extending through a bore formed in said terminal fastener and in threaded engagement with said pin, said expander rod having a tapered portion positioned within said tapered internal bore of said pin and adjustable to cause said at least one expansible conductor portion to expand outwardly.

21. The electrical connector claimed in claim 20 wherein said pin has an externally and internally threaded stud for threaded engagement by said fastener and said expander, respectively.

22. The electrical connector claimed in claim 20 wherein said pin has an annular outwardly extending flange, said electrical terminal being secured between said fastener and said flange.

23. The electrical connector claimed in claim 20 wherein said fastener includes at least one flat surface formed along a chord line thereof.

24. The electrical connector claimed in claim 23 wherein said fastener includes at least two flat surfaces formed along parallel chordal lines thereof.

* * * * *